US010696462B2

(12) United States Patent
Ryszawy

(10) Patent No.: US 10,696,462 B2
(45) Date of Patent: Jun. 30, 2020

(54) CLOSURE ASSEMBLY FOR A BAG AND A METHOD OF CLOSING THE BAG

(71) Applicant: Edyta Ryszawy, Buffalo Grove, IL (US)

(72) Inventor: Edyta Ryszawy, Buffalo Grove, IL (US)

( * ) Notice: Subject to any disclaimer, the term of this patent is extended or adjusted under 35 U.S.C. 154(b) by 59 days.

(21) Appl. No.: 15/870,576

(22) Filed: Jan. 12, 2018

(65) Prior Publication Data

US 2018/0208384 A1 Jul. 26, 2018

Related U.S. Application Data

(60) Provisional application No. 62/448,862, filed on Jan. 20, 2017.

(51) Int. Cl.

| | |
|---|---|
| ***B65D 77/10*** | (2006.01) |
| ***B65D 77/14*** | (2006.01) |
| ***B65D 33/16*** | (2006.01) |
| *B65B 7/06* | (2006.01) |
| *B65D 77/12* | (2006.01) |
| *B65B 7/28* | (2006.01) |

(52) U.S. Cl.

CPC ..... *B65D 77/14* (2013.01); *B65D 33/16* (2013.01); *B65D 33/1658* (2013.01); *B65B 7/06* (2013.01); *B65B 7/285* (2013.01); *B65D 77/12* (2013.01)

(58) Field of Classification Search

CPC ..... B65B 7/06; B65B 7/285; B65D 77/14; B65D 33/16; B65D 33/1658; B65D 77/12

USPC ..... 24/30.5 P, 30.5 R, 30.5 S, 30.5 L, 543; D9/443, 449; D8/394, 395; D13/125

See application file for complete search history.

(56) References Cited

U.S. PATENT DOCUMENTS

| | | | | |
|---|---|---|---|---|
| 3,707,271 | A * | 12/1972 | Sanchez | B65B 7/02 248/101 |
| D264,689 | S * | 6/1982 | Miller | D9/434 |
| D412,116 | S * | 7/1999 | DuCorday | D9/434 |
| 6,233,786 | B1 * | 5/2001 | Lin | A45C 3/04 16/114.1 |
| D474,968 | S * | 5/2003 | Hicks | D9/435 |
| 8,505,172 | B2 * | 8/2013 | Termanini | B65D 81/3266 24/30.5 L |
| 2008/0118189 | A1 * | 5/2008 | Johnson | B65D 33/2591 383/64 |
| 2009/0211059 | A1 * | 8/2009 | Byron | B65D 33/06 24/30.5 R |
| 2017/0225842 | A1 * | 8/2017 | Yeh | B65D 33/2508 |

* cited by examiner

*Primary Examiner* — William V Gilbert

(57) ABSTRACT

A closure assembly for a bag, comprises, a first closure having a first longitudinal member, the first longitudinal member having a first end and a second end, the longitudinal member being provided with a clamping arrangement adapted to clamp a bag, the clamping arrangement comprising a first clamp at the first end and a second clamp at the second end, wherein, a bottom surface of the longitudinal member comprises two edges adapted to be separated under force and snap into a closed position elastically, wherein the first clamp and the second clamp are adapted to limit the separation between the two edges and a second closure having a second longitudinal member, the second longitudinal member having a hollow cross section defining a cavity adapted to receive the first closure.

4 Claims, 11 Drawing Sheets

CLOSURE ASSEMBLY FOR A BAG AND A METHOD OF CLOSING THE BAG

CROSS-REFERENCE TO RELATED APPLICATIONS

This application claims the benefit of provisional patent application Ser. No. 62/448,862 filed 20 Jan. 2017 by the present inventor.

FIELD OF INVENTION

The present invention generally relates to closures used for sealing bags containing edible items and more particularly to a closure assembly for a bag and a method for closing the bag.

BACKGROUND ART

The thick and inflexible silicone bags were created to be used in many areas to meet a growing need for reusable and eco-friendly alternative to plastic bags. While the plastic bags can be washed by hand, the thin plastic layers are not suited for machine washing, making washing of the bags inconvenient and undesirable to most users. Thus, the plastic bags are often disposed of after only a single or few uses.

In addition to not being reusable, plastic bags are made from a limited resource (fossils fuels) and contain many dangerous chemicals such as BPA, BPS, BPF, PVC and phthalates, which can migrate out of plastic and pose danger to people's health. The excess plastic waste pollutes the environment endangering aquatic and soil organisms. The public perception is that the disposal of plastic bags after a single or only a few uses is increasing viewed as wasteful and environmentally harmful.

The use of silicone to replace plastic is both better for people's health and for the environment. Silicone is made from a plentiful resources (silica), is reusable, does not contain any dangerous chemicals and does not release any chemicals into the environment, is resistant to extreme temperatures, is recyclable and non-toxic to aquatic and soil organisms. Today, more than ever, there is a growing desire to use alternative products that are reusable and environmentally friendly. Therefore, there is a growing need for the reusable silicone bags as an alternative to plastic bags that would appeal to a broad spectrum of customers.

The silicone bags can be used in many areas, however, due to silicone exceptional temperature and chemical resistance, they are best suited for use in kitchenware for food storage, heating, cooking, steaming, and freezing.

Such silicone bags are typically made from silicone material that provides an internal volume into which the food items can be inserted. To access the internal volume, the storage bag is typically formed with an opening. Furthermore, to otherwise prevent the contents from spilling out of the bag, the silicone bag typically also includes a closure system for closing the opening. To allow for repeated access to the internal volume, the plastic closure systems are commonly utilized to repeatedly attach to and disconnect from the bag.

The prior art closure system for thick, inflexible bags of the type is a molded one-piece hard plastic roll-on bar that slides along both edges of the silicone bag from one side to the other to close it. This type of closure is unsatisfactory in several respects. It is only air-tight and, therefore, it does not provide the versatility to meet the needs of today's consumer. Said roll-on bar closure is difficult to move along edges of the bag to close it, sometimes requiring the use of oil to lubricate it to fully close the bag. Furthermore, said roll-on bar closure is not microwave-friendly and does not allow for versatility of use in the microwave. Furthermore, said roll-on bar closure frequently does not provide an airtight seal which is essential in order to prevent food spoilage.

In light of the discussion above, there is required a closure assembly for a bag and a method of closing the bag, that does not suffer from above mentioned deficiencies.

Throughout this specification, unless the context requires otherwise, the words "comprise", "comprises" and "comprising" will be understood to imply the inclusion of a stated step or element or group of steps or elements but not the exclusion of any other step or element or group of steps or elements.

Any one of the terms: "including" or "which includes" or "that includes" as used herein is also an open term that also means including at least the elements/features that follow the term, but not excluding others.

Any discussion of the background art throughout the specification should in no way be considered as an admission that such background art is prior art nor that such background art is widely known or forms part of the common general knowledge in the field in United States or worldwide.

SUMMARY OF THE INVENTION

According to a first aspect of the present invention, there is provided a closure assembly for a bag, comprising a first closure having a first longitudinal member, the first longitudinal member having a first end and a second end, the longitudinal member being provided with a clamping arrangement adapted to clamp a bag, wherein a bottom surface of the longitudinal member comprises two edges adapted to be separated under force and snap into a closed position, elastically, a second closure having a second longitudinal member, the second longitudinal member having a hollow cross section defining a cavity adapted to receive the first closure. Further, the first closure is adapted to receive an opening of the bag between the two edges, thereby providing a sealing to contents inside the bag. Also, the second closure is adapted to fasten the two edges against separation, thereby providing further sealing to the contents inside the bag.

In one embodiment of the invention, the first closure and the second closure are made up of a thermoplastic material.

In one embodiment of the invention, the thermoplastic material is a microwave friendly plastic material.

In one embodiment of the invention, the clamping arrangement further comprises a first clamp at the first end and a second clamp at the second end, the first clamp and the second clamp being adapted to limit the separation between the two edges.

In one embodiment of the invention, the two edges are designed to have a predetermined elasticity in order provide a gap adapted for venting of air trapped inside the bag.

In one embodiment of the invention, the hollow cross-section is selected from a group consisting of a U-shaped cross-section, a square shaped cross-section and a triangular shaped cross-section.

According to a second aspect of the present invention, there is provided a method of closing a bag, using a closure assembly having a first closure and a second closure, the method comprising steps of receiving an opening of the bag between two edges of the first closure, thereby providing sealing to contents inside the bag and fastening the two edges against separation by the second closure, thereby providing further sealing to the contents inside the bag. Further, the first closure has a first longitudinal member, the first longitudinal member having a first end and a second end, the longitudinal member being provided with a clamping arrangement for clamping the bag, wherein a bottom surface of the longitudinal member comprises two edges for separating under force and snapping into a closed position elastically. Further, the second closure has a second longitudinal member, the second longitudinal member having a hollow cross section defining a cavity for receiving the first closure.

In one embodiment of the invention, the first closure and the second closure are made up of a thermoplastic material.

In one embodiment of the invention, the thermoplastic material is a microwave friendly plastic material.

In one embodiment of the invention, the clamping arrangement further comprises a first clamp at the first end and a second clamp at the second end, the first clamp and the second clamp limiting the separation between the two edges.

In one embodiment of the invention, the two edges are designed to have a predetermined elasticity in order provide a gap adapted for venting of air trapped inside the bag.

In one embodiment of the invention, the hollow cross-section is selected from a group consisting of a U-shaped cross-section, a square shaped cross-section and a triangular shaped cross-section.

BRIEF DESCRIPTION OF THE DRAWINGS

At least one example of the invention will be described with reference to the accompanying drawings, in which.

It should be noted that the same numeral represents the same or similar elements throughout the drawings.

DETAILED DESCRIPTION OF THE EMBODIMENTS

Figure 1:
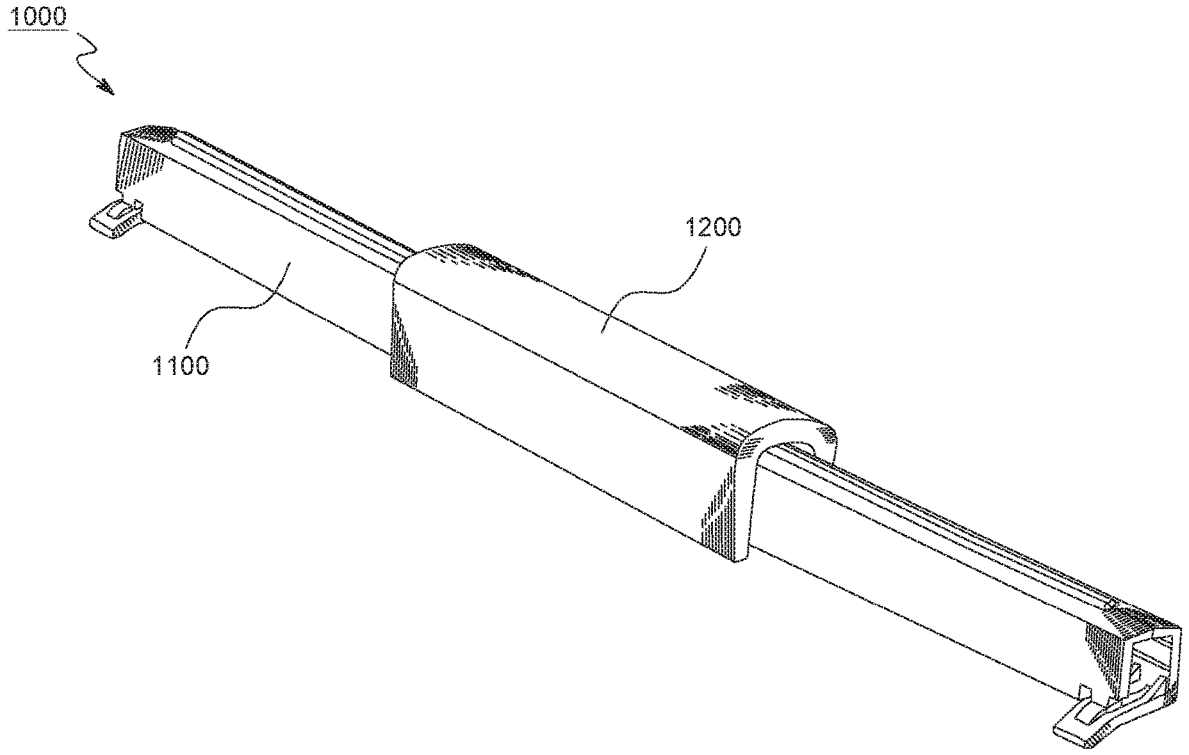
FIG. 1 illustrates a front perspective view of a closure assembly in accordance with an embodiment of the present invention.
Figure 2:
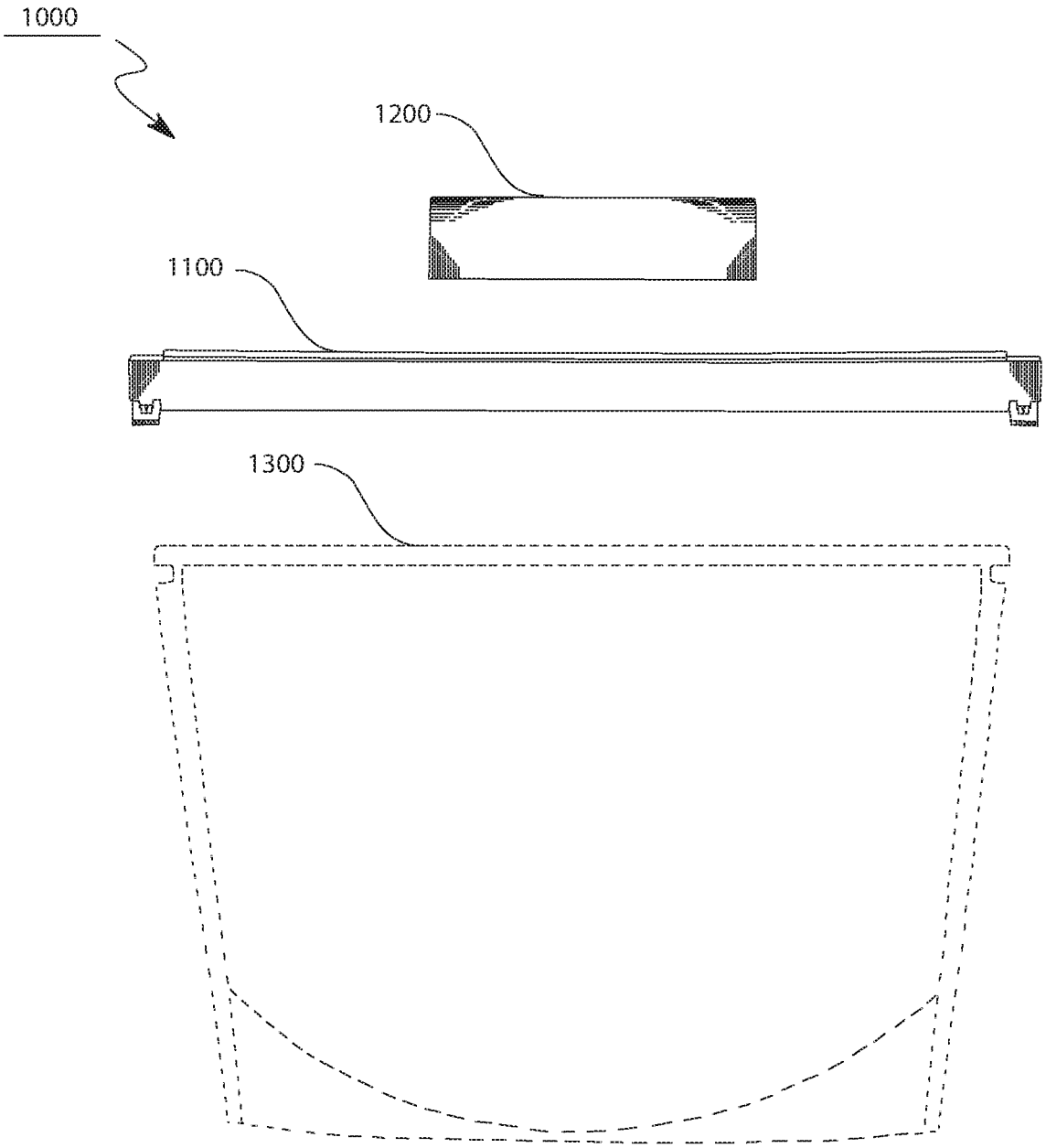
FIG. 2 illustrates a front elevation view of a first closure and a second closure, separately, in relation to a bag, in accordance with an embodiment of the present invention.

FIG. 1 illustrates a front perspective view of a closure assembly 1000 in accordance with an embodiment of the present invention. As shown in FIG. 1, the closure assembly 1000 has a first closure 1100 and a second closure 1200. FIG. 2 illustrates a front elevation view of the first closure 1100 and the second closure 1200, separately, in relation to a bag 1300, in accordance with an embodiment of the present invention. The length of the first closure 1100 is envisaged to exceed the length of the bag 1300. In various embodiments of the invention, the bag 1300 is made up of silicone material. It is to be noted here, that the bag 1300 is shown in dotted lines as the bag 1300 is not a part of the present invention, and has been shown only for illustrative purpose. The same is true for other figured depicting the bag 1300 in them.

Figure 3:
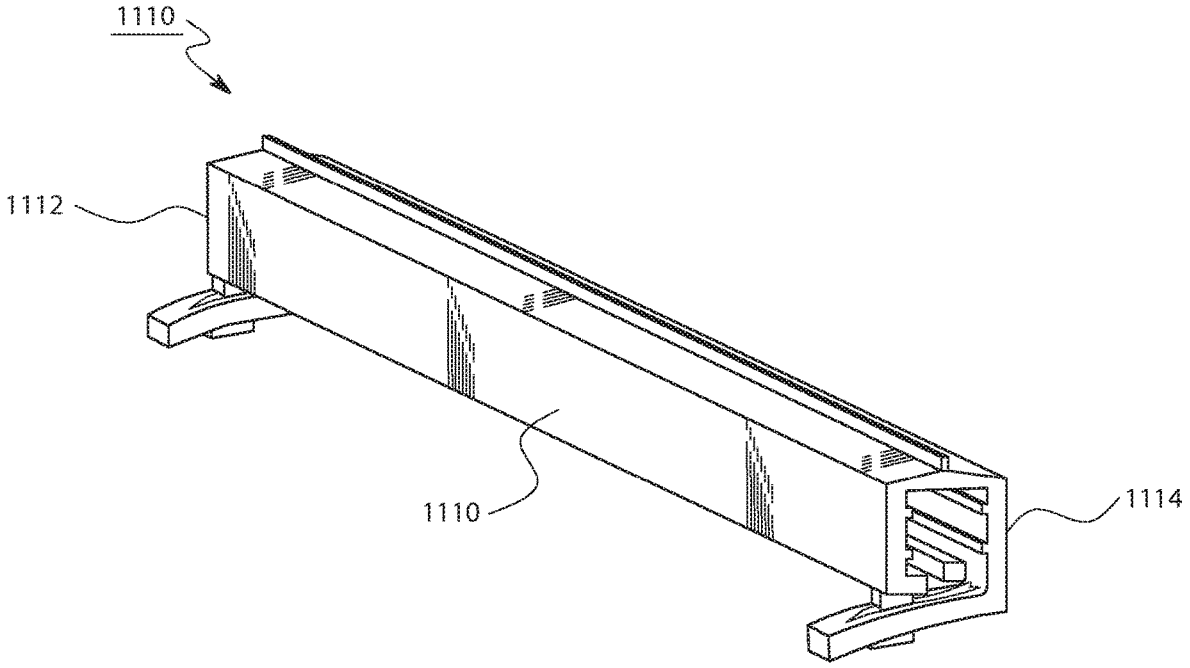
FIG. 3 illustrates a top perspective view of the first closure, in accordance with an embodiment of the present invention.
Figure 4:
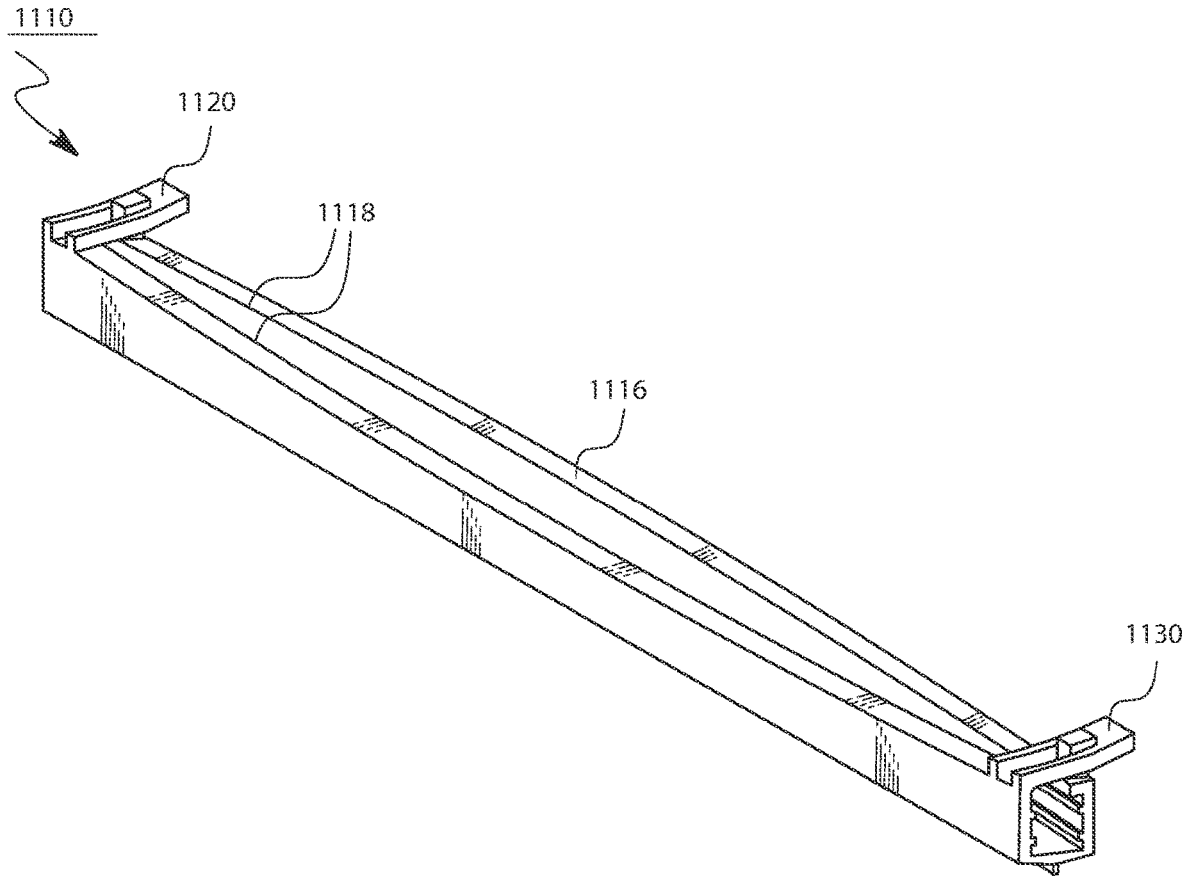
FIG. 4 illustrates a bottom perspective view of the first closure, in accordance with an embodiment of the present invention.

FIG. 3 illustrates a top perspective view of the first closure 1100, in accordance with an embodiment of the present invention. The first closure 1100 has a first longitudinal member 1110. Further, the first longitudinal member 1100 has a first end 1112 and a second end 1114. Further, the first closure 1100 has been provided with a clamping arrangement adapted to clamp the bag 1300. FIG. 4 illustrates a bottom perspective view of the first closure 1100, in accordance with an embodiment of the present invention. A bottom surface 1116 of the longitudinal member 1110 comprises two edges 1118 adapted to be separated under force and snap into a closed position, elastically. Here, the two edges 1118 are envisaged to be a part of the clamping arrangement. In various embodiments, the clamping arrangement further comprises a first clamp 1120 at the first end 1112 and a second clamp 1130 at the second end 1114.

Figure 5:
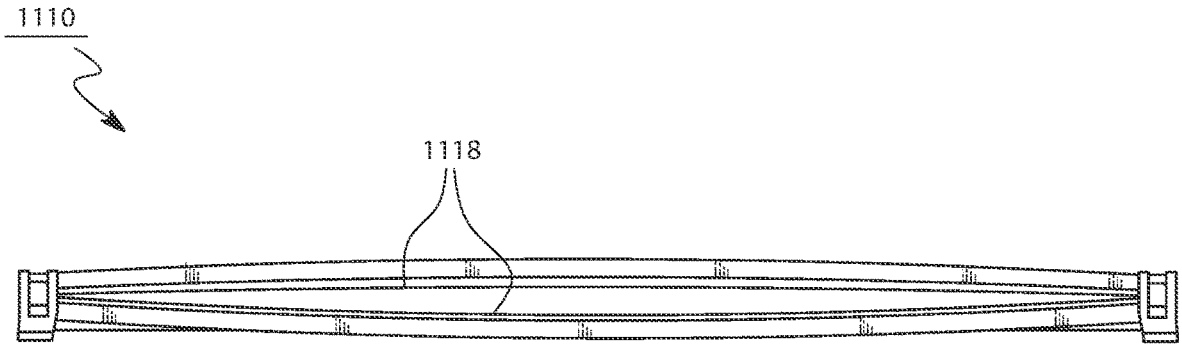
FIG. 5 illustrates a bottom view of the first closure with two edges separated, in accordance with an embodiment of the present invention.
Figure 6:
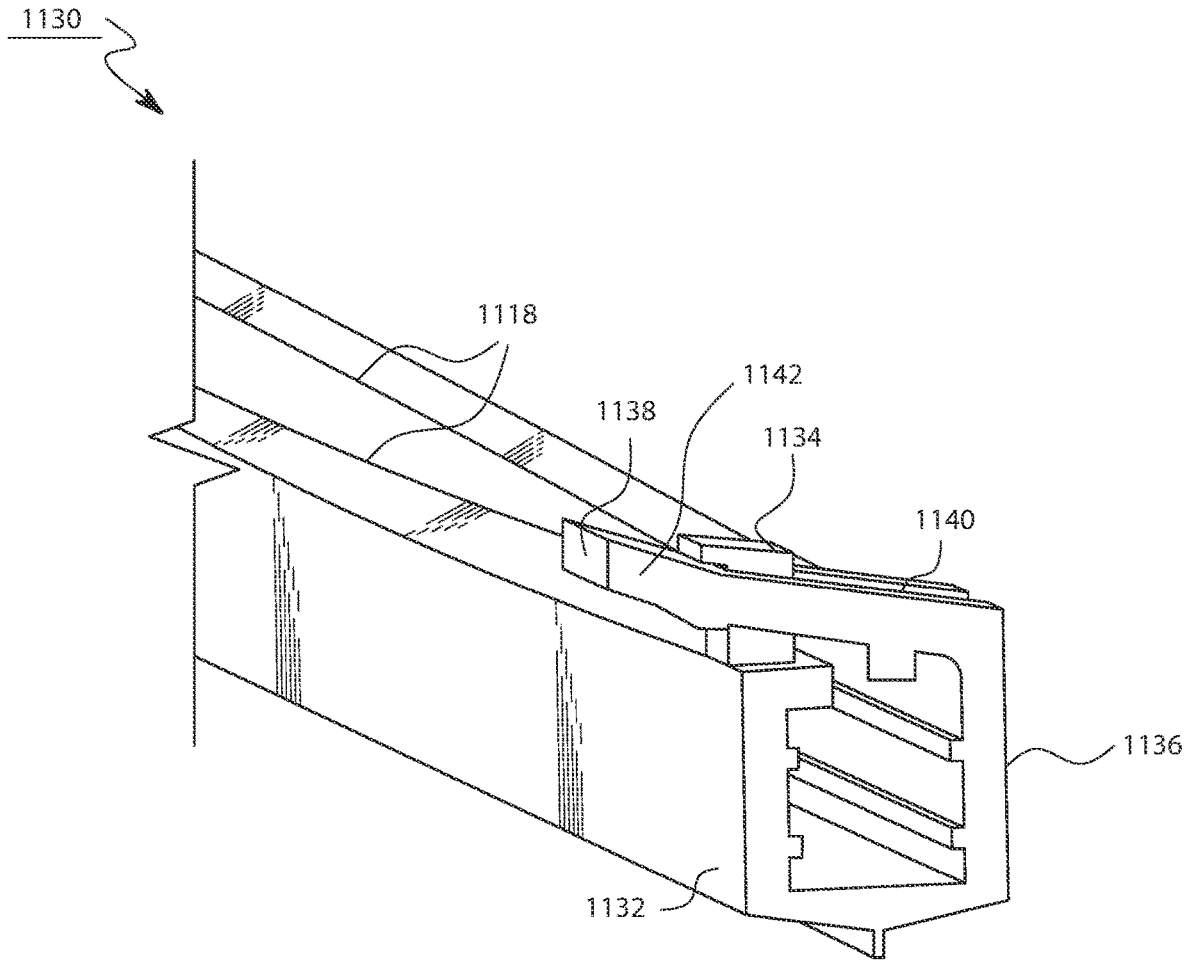
FIG. 6 illustrates a magnified view of a second clamp of the first closure, in accordance with an embodiment of the present invention.

FIG. 5 illustrates a bottom view of the first closure 1100 with the two edges 1118 separated, in accordance with an embodiment of the present invention. When separated, the two edges 1118 an arch-shaped curvature. The arch-shaped curvature is the largest in the middle of the first closure 1110 and disappears at the first end 1112 and the second end 1114, where the first clamp 1120 and the second clamp 1130, respectively, are located. It is envisaged here, that the first clamp 1120 and the second clamp 1130 are adapted to limit the separation between the two edges 1118. FIG. 6 illustrates a magnified view of the second clamp 1130 of the first closure 1100, in accordance with an embodiment of the present invention. The second clamp 1130 has a first side 1132 having a fixed base 1134. Further, the second clamp 1130 has a second side 1136 having a flexible arm 1138. The flexible arm 1138 has a groove portion 1140 and by a solid portion 1142. The fixed base 1134 is adapted to slide within the groove portion 1140, when the two edges 1118 are separated and the sliding of the fixed base 1134 is limited by the solid portion 1142, thereby limiting the separation of the two edges 1118.

Figure 7:
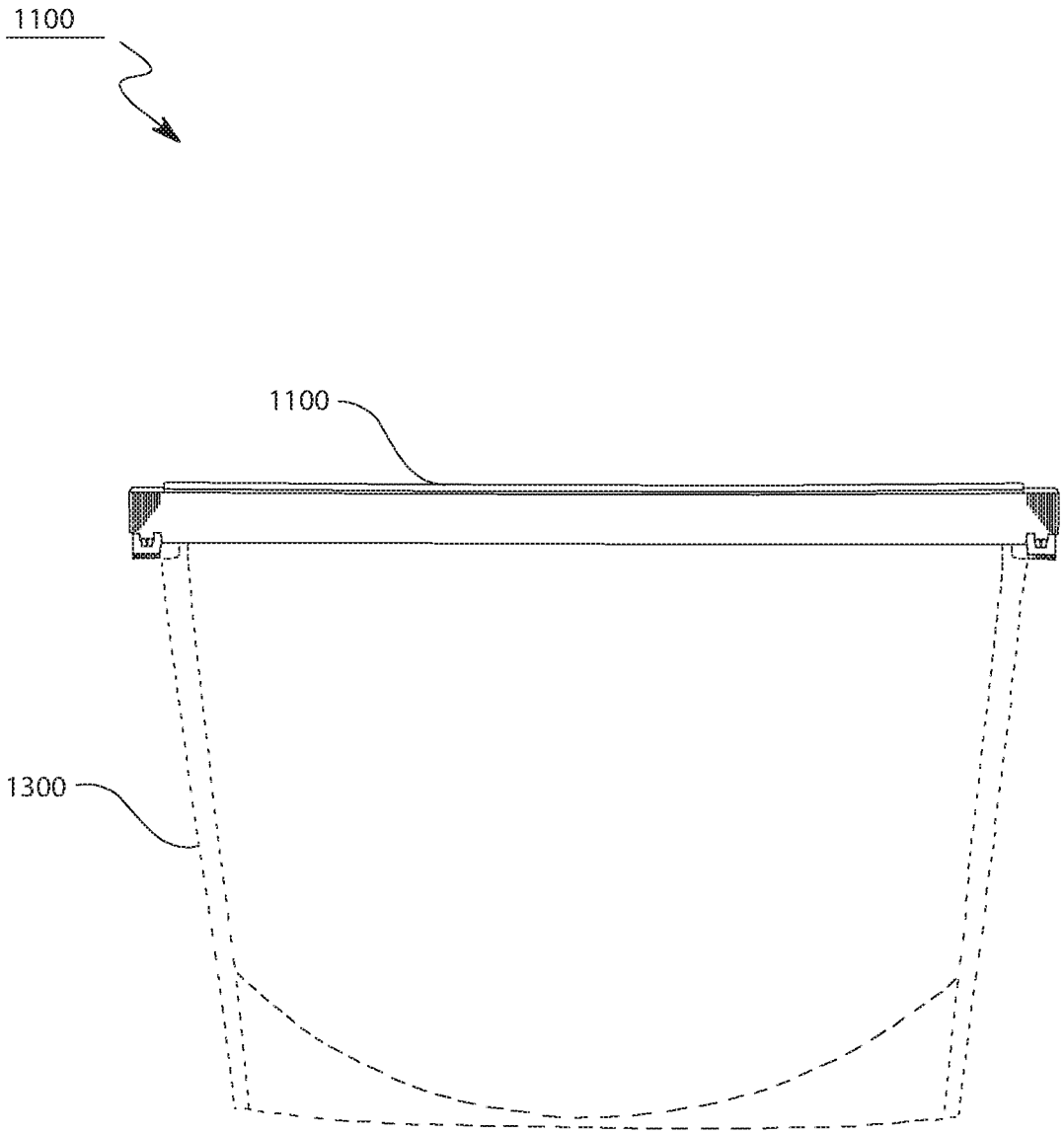
FIG. 7 illustrates the first closure attached to the bag, creating an air-venting seal, in accordance with an embodiment of the present invention.

The first closure 1100 is adapted to receive an opening of the bag 1300 between the two edges 1118, thereby providing a sealing to contents inside the bag 1300. FIG. 7 illustrates the first closure 1100 attached to the bag 1300, creating an air-venting seal, in accordance with an embodiment of the present invention. In various embodiment of the invention, the two edges 1118 are designed to have a predetermined elasticity in order provide a gap adapted for venting of air trapped inside the bag 1300. This allows the air having humidity and other biological contaminants to be pushed out of the bag 1300, keeping the contents fresh for a relatively longer duration.

Figure 8:
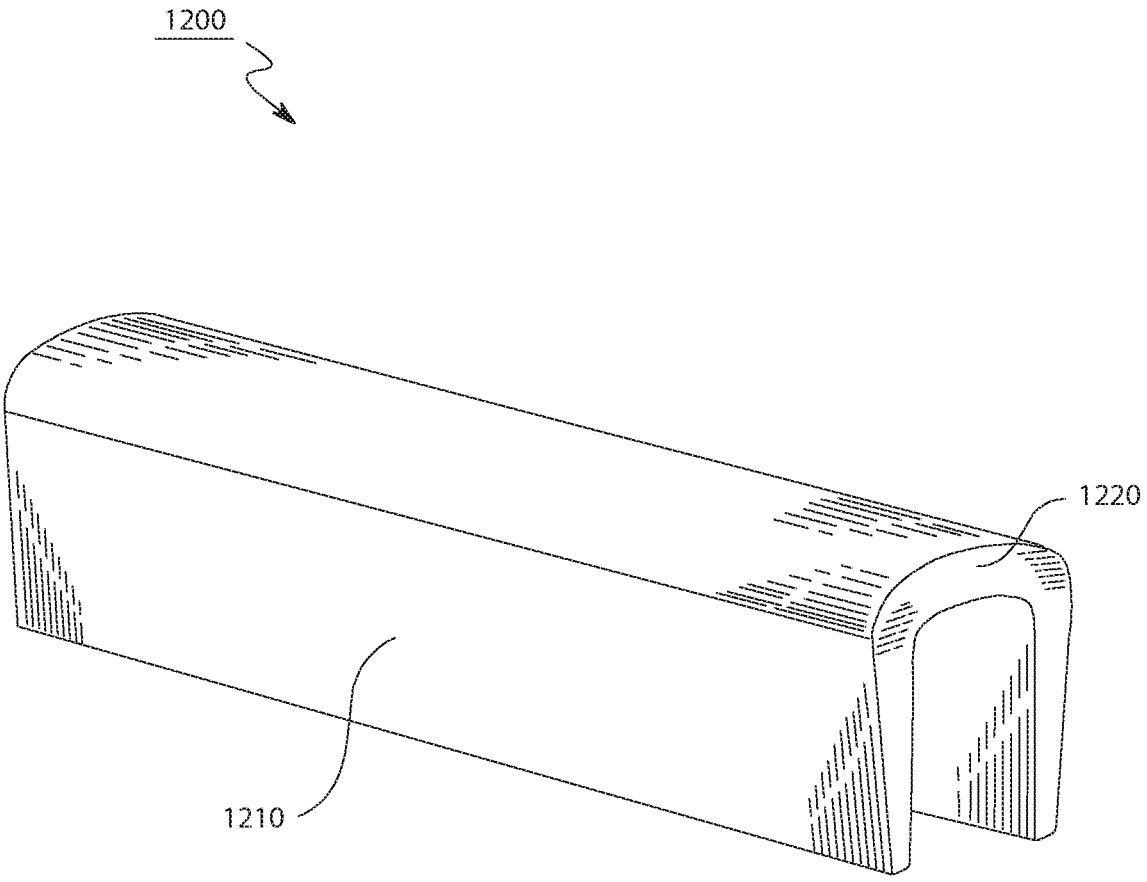
FIG. 8 illustrates a front perspective view of the second closure, in accordance with an embodiment of the present invention.
Figure 9:
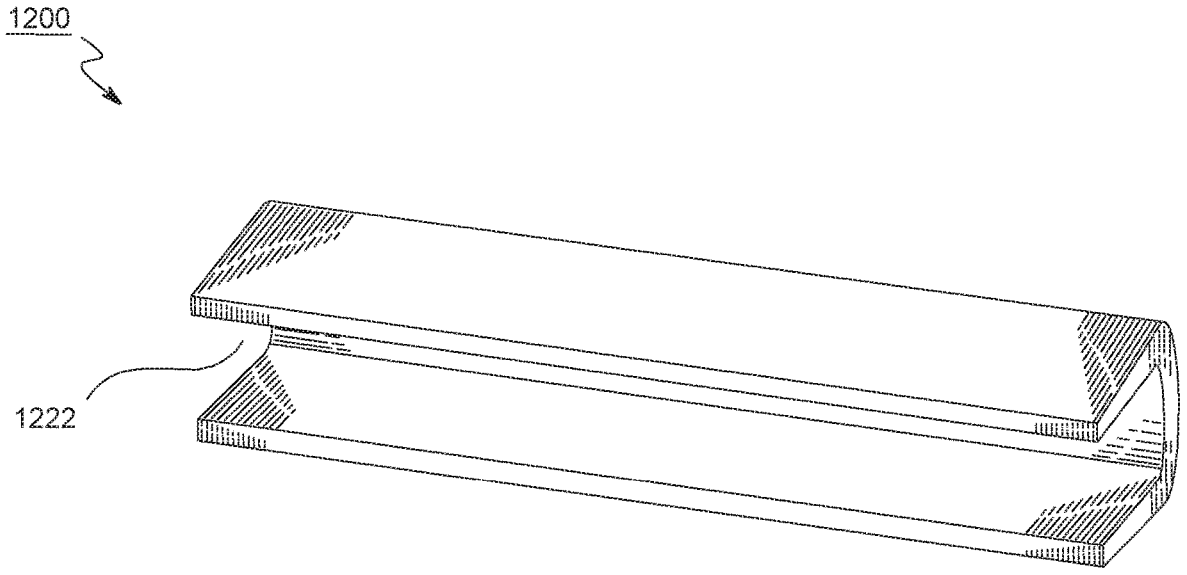
FIG. 9 illustrates a bottom perspective view of the second closure, in accordance with an embodiment of the present invention.

FIG. 8 illustrates a front perspective view of the second closure 1200, in accordance with an embodiment of the present invention. The second closure 1200 has a second longitudinal member 1210. Further, the second longitudinal member 1210 has a hollow cross section 1220. In various embodiments, the hollow cross-section 1220 is selected from a group consisting of a U-shaped cross-section, a square shaped cross-section and a triangular shaped cross-section. FIG. 9 illustrates a bottom perspective view of the second closure 1200, in accordance with an embodiment of the present invention. As shown, the hollow cross section 1220 defines a cavity 1222 adapted to receive the first closure 1100.

Figure 10:
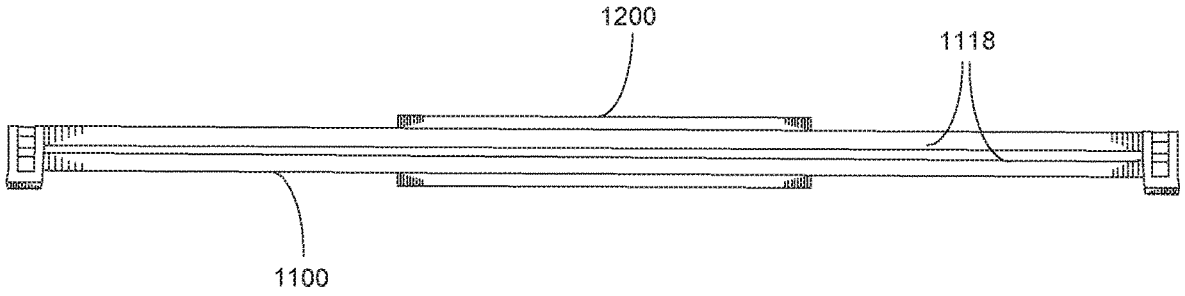
FIG. 10 illustrates a bottom view of the first closure with two edges snapped into a closed position, in accordance with an embodiment of the present invention.
Figure 11:
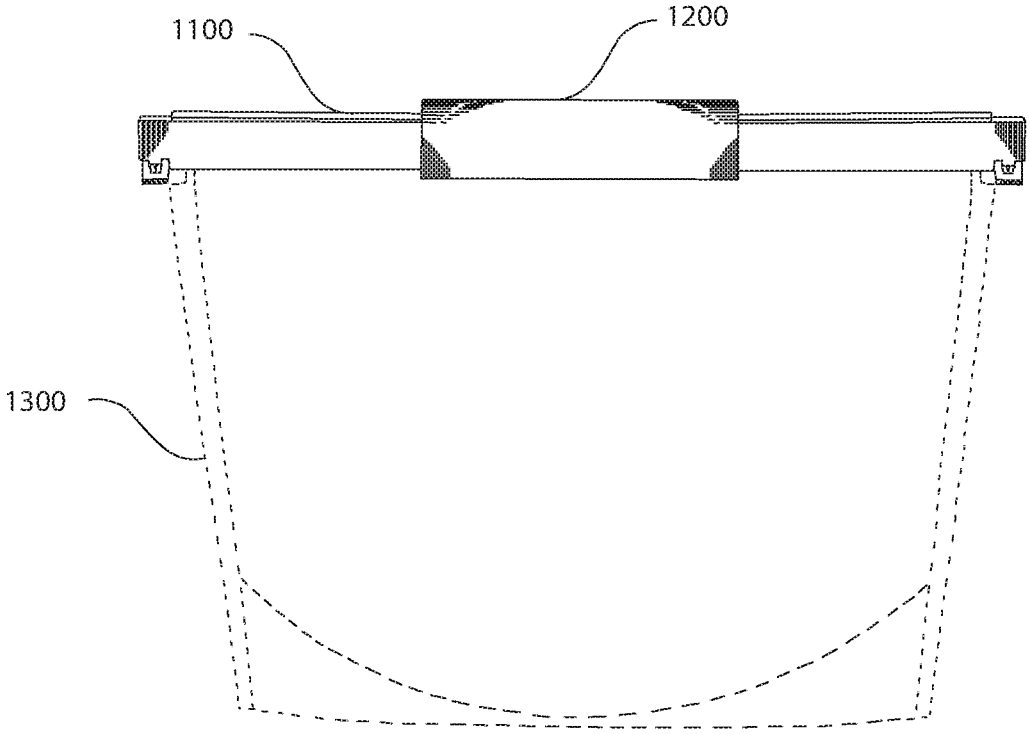
FIG. 11 illustrates a front elevation view of the bag with the closure assembly attached, creating a leak-proof seal, in accordance with an embodiment of the present invention.

FIG. 10 illustrates a bottom view of the first closure with two edges 1118 snapped into the closed position, in accordance with an embodiment of the present invention. The second closure 1200 is adapted to fasten the two edges 1118 against separation, thereby providing further sealing to the contents inside the bag 1300. FIG. 11 illustrates a front elevation view of the bag 1300 with the closure assembly 1000 attached, creating a leak-proof seal, in accordance with an embodiment of the present invention.

In various embodiments, the first closure 1100 and the second closure 1200 are made up of a thermoplastic material. It is further envisaged that the thermoplastic material is a microwave friendly plastic material. Examples of suitable thermoplastic materials include polyethylene (PE), high density polyethylene (HDPE), low density polyethylene (LDPE), linear low density polyethylene (LLDPE), polypropylene (PP), ethylene vinyl acetate (EVA), Nylon long chain fiber forming polyamide, polyester, polyamide, ethylene vinyl alcohol, and can be formed in single or multiple layers. The thermoplastic material can be transparent, translucent, opaque, or tinted. However, the first closure 1100 and the second closure 1200 are not limited by these materials. Wood, plastic, rubber, foam, metal alloys, aluminum and other materials may comprise some or all of the elements in various embodiments.

In use, the two edges 1118 are separated under force. However, the first clamp 1120 and the second clamp 1130 limit the separation between the two edges 1118. The opening of the bag 1300 is received between two edges 1118 of the first closure 1100, thereby providing sealing to contents inside the bag 1300. The two edges 1118, that arch-shaped curved and open, do not adhere closely to the edges of the bag 1300, creating a very small space in between. The space created is the largest in the middle of the first closure 1100 at the top of the arch and disappears at the first and the second ends 1112 and 1114. This small space allows for air movement in and out the bag 1300, which creates the air-venting seal.

Further, the two edges 1118 are elastically snapped into the closed position. Further, the two edges 1118 are fastened against separation by the second closure 1200, when the first closure is received in the cavity 1222, thereby providing further sealing to the contents inside the bag 1300. The second closure 1200 can be introduced by pushing the second closure 1200 downwards onto the first closure 1100. This eliminates any space in between the two edges 1118 of the clamping arrangement and the edges of the bag 1300 creating the leak-proof seal.

From the description above, advantages of some embodiments of the present invention become evident, viz.:

i. The present invention can be used to seal bags (silicone and other included) easily and conveniently, can be removed just as easily and without damage to the bag, and can be used to reseal the bag.

ii. The present invention provides a versatile air-venting or leak-proof seal for use with the silicone bags to meet the needs of today's consumer. The air-venting seal protects the contents of the bag from spilling, but allows for the manual air removal from the bag to extend food freshness. Furthermore, the air-venting seal can be used during the food steaming in the microwave, the stove or the oven. During steaming of the bag with food inside, the air-venting seal allows for the steam generated during heating to escape safely. The leak-proof seal makes the bag completely leak-proof. The leak-proof closure can be used during the food storage or sous vide low-temperature cooking.

iii. The present invention provides a new and improved closure assembly 1000, that is especially suited for silicone food bags or other uses which is inexpensive to manufacture, which is durable and long-lasting in construction, which is simple to use, and, which is otherwise particularly well adapted for its intended purposes.

The terms and descriptions used herein are set forth by way of illustration only and are not meant as limitations. Examples and limitations disclosed herein are intended to be not limiting in any manner, and modifications may be made without departing from the spirit of the present disclosure. Those skilled in the art will recognize that many variations are possible within the spirit and scope of the disclosure, and their equivalents, in which all terms are to be understood in their broadest possible sense unless otherwise indicated.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing broadest scope of consistent with the principles and the novel and inventive features disclosed or suggested herein. Accordingly, the disclosure is anticipated to hold on to all other such alternatives, modifications, and variations that fall within the scope of the present disclosure and appended claims.

The invention claimed is:

1. A closure assembly for a bag, comprising:

a first closure having a first longitudinal member, the first longitudinal member being provided with a clamping arrangement adapted to clamp the bag, wherein the first longitudinal member comprises a first and a second separate elongated opposing members each having a top side and an unattached bottom side, a first end and a second end, the first and the second separate elongated opposing members being attached along the respective top sides by a connecting portion and forming a channel section, the first and the second ends of the first opposing member each comprise a fixed base and the first and the second ends of the second opposing member each comprise a flexible arm having a groove configured to receive a respective one of the fixed bases, the first closure being adapted to be separated under force and snap into a closed position, elastically;

a second closure comprising a second longitudinal member having a first and a second elongated members being connected by a second connecting portion, the second longitudinal member having a hollow cross-section defining a second channel adapted to receive the first closure, wherein the first opposing member of the first closure abuts the first elongated member of the second closure, the second opposing member of the first closure abuts the second elongated member of the second closure and the connecting portion of the first closure abuts the second connecting portion of the second closure;

wherein the first closure is adapted to receive an opening of the bag between the unattached bottom sides of the separate elongated opposing members, thereby providing a sealing of the bag; and wherein the second closure is adapted to fasten the first and the second elongated opposing members of the first closure against separation of the bag.

2. The closure assembly as claimed in claim 1, wherein the first closure and the second closure are made of a thermoplastic material.

3. The closure assembly as claimed in claim 2, wherein the first closure is made of polypropylene (PP).

4. The closure assembly as claimed in claim 1, wherein the hollow cross-section is selected from the group consisting of a U-shaped cross-section, a square shaped cross-section and a triangular shaped cross-section.

* * * * *